US005131836A

United States Patent [19]

Coppin

[11] Patent Number: 5,131,836

[45] Date of Patent: Jul. 21, 1992

[54] LINE BURNER ASSEMBLY

[75] Inventor: William P. Coppin, Muncie, Ind.

[73] Assignee: Maxon Corporation, Muncie, Ind.

[21] Appl. No.: 651,593

[22] Filed: Feb. 6, 1991

[51] Int. Cl.[5] ..... F23N 3/00; F27B 17/00

[52] U.S. Cl. ..... 431/12; 431/5; 431/351; 432/187

[58] Field of Search ..... 431/12, 5, 2, 351; 110/345, 210, 211, 212, 214; 432/187, 194, 196, 145

[56] References Cited

U.S. PATENT DOCUMENTS

| | | | |
|---|---|---|---|
| Re. 25,626 | 7/1964 | Yeo et al. . | |
| 3,178,161 | 4/1965 | Yeo et al. . | |
| 3,297,259 | 1/1967 | Maxon, Jr. et al. . | |
| 3,869,243 | 3/1975 | Creuz | 431/12 X |
| 4,036,576 | 7/1977 | McCracken | 110/212 X |
| 4,144,014 | 3/1979 | Hartwig | 431/5 |
| 4,340,180 | 7/1982 | Belknap et al. . | |
| 4,403,947 | 9/1983 | Spielman . | |
| 4,483,832 | 11/1984 | Schirmer | 431/5 X |
| 4,573,907 | 3/1986 | Coppin et al. . | |
| 4,869,665 | 9/1989 | Coppin . | |
| 4,963,089 | 10/1990 | Spielman . | |

*Primary Examiner*—Larry Jones
*Attorney, Agent, or Firm*—Barnes & Thornburg

[57] ABSTRACT

A line burner assembly is provided for burning a mixture including at least a gaseous fuel and process air to produce a flame. The assembly includes a mixing region which contains an air/fuel mixture. Gaseous fuel and process air are supplied to the mixing region. Combustion air containing oxygen may also be supplied manually or automatically to the mixing region to compensate for a decline in the oxygen level in the process air below a predetermined minimum level to enhance the combustibility of the air/fuel mixture in the mixing region.

39 Claims, 1 Drawing Sheet

LINE BURNER ASSEMBLY

BACKGROUND AND SUMMARY OF THE INVENTION

This invention relates to a gaseous fuel burner assembly, and, in particular, to a line burner assembly for burning a mixture of gaseous fuel and process air. More particularly, the invention relates to a line burner assembly which is able to compensate for variations in the oxygen level in the process air which is mixed with the gaseous fuel to maintain a stable flame during operation of the line burner.

It is known to provide elongated line burners which are formed to include a plurality of gaseous fuel openings and a plurality of air openings along the length of the burner. Such line burners are known as "nozzle mix" line burners. Examples of nozzle mix line burners are shown in U.S. Pat. Nos. 4,340,180 and 4,403,947.

It is also known to supply a premixed gaseous fuel and combustion air mixture to a manifold of a line burner and ignite the mixture to produce a flame. Examples of "premix" line burners are shown in U.S. Pat. Nos. Re. 25,626; 3,178,161; 3,297,259; 4,573,907; and 4,869,665.

Line burners are useful in various industrial applications where it is required to have a specific temperature distribution over a predetermined space or area. Examples of applications where line burners are used include graphics applications, incinerators, turbine boosters, and board dryers. In a graphics application, for example, premix line burners are used to generate hot air to dry ink or solvents from printing presses.

Process air is that air that is produced in a factory or industrial process and found to contain various inert matter entrained therein. It is desirable to dispose of this process air in an environmentally sound way to minimize unwanted discharge of inert matter into the environment. One way to dispose of many of the contaminants entrained in process air is to incinerate it by burning a mixture of gaseous fuel and process air in a line burner. For example, process air containing solvents emitted from a printing press can be introduced into a line burner and mixed with gaseous fuel to produce a flammable mixture. These entrained solvents are incinerated by the flame of the line burner as the process air passes through the mixing region of the line burner and the mixture of gaseous fuel and process air is ignited. It is important that this mixture contain enough oxygen to kindle or sustain a flame.

Problems exist when burning a mixture of process air and gaseous fuel in a burner assembly. Occasionally, the oxygen level in the process air can drop below a minimum acceptable level during operation of the line burner. This drop in the oxygen level in the process air can cause the line burner to become unstable and the flame to be retarded or extinguished. In addition, the oxygen level in the process air is often not capable of supporting the type of high intensity flame which may be required in some applications.

In some instances, the process air stream supplied to a line burner will be low in inerts and relatively high in oxygen and flammable vapors, presenting the burner with a combustible mixture. The line burner can be operated using only a mixture of gaseous fuel and process air in such circumstances. However, in some instances, the process air might not have a composition sufficient to combine with gaseous fuel to produce a satisfactory burnable mixture. This development can lead to disfunction of a line burner set up to burn a mixture of gaseous fuel and process air. The level of inerts and oxygen contained in process air can vary over time so that the quality of the process air does not always contain enough oxygen to support a flame properly when burned.

One object of the present invention is to provide a line burner capable of compensating for intermittent decline in the oxygen level or rise in the inert level in the process air being mixed with a gaseous fuel supply to produce a flame or to maintain the stability of the flame.

According to one aspect of the present invention, a line burner assembly is provided for burning a mixture including at least a gaseous fuel and process air to produce a flame. The assembly includes means for providing a mixing region and means for supplying a gaseous fuel to the mixing region. The assembly also includes means for introducing process air containing oxygen and inerts into the mixing region to mix with the gaseous fuel in the mixing region to produce a mixture. The assembly further includes means for compensating for a decline in the oxygen level in the process air below a predetermined minimum level by introducing combustion air into the mixing region to supplement the process air therein and increase the oxygen level of the mixture above a threshold level to enhance the combustability of the mixture in the mixing region, thereby supporting the flame produced therein.

In the illustrated embodiment of the present invention, the compensating means includes means for supplying combustion air to the mixing region and means for intermittently or periodically activating the supplying means to cause combustion air to be supplied to the mixing region to support the flame produced therein when the oxygen level in the process air falls below a predetermined minimum level. It will be understood that "combustion air" (as used herein) is any air which has a high level of oxygen such that it can mix with gaseous fuel to produce a combustible mixture.

In the illustrated embodiment, duct means is provided for directing process air toward the mixing region of the line burner. Means is also provided for circulating process air through the duct means and into the mixing region so that is mixed with gaseous fuel or a mixture of gaseous fuel and combustion air introduced into the mixing region.

In certain line burner applications, such as the graphics application discussed previously, it can often be predicted when the oxygen level in the process air is likely to fall below the predetermined threshold level required to support the flame. Typically, after firing up the line burner in a graphics application, the oxygen level of the process air will drop below the predetermined threshold level for a known predetermined time period. During this initial fire-up time period, it is advantageous to add combustion air to the mixing region in accordance with the present invention to support the flame. After this initial fire-up time period, however, the oxygen level of the process air typically rises above the predetermined threshold level and is capable of supporting the flame without the addition of any combustion air.

Therefore, in a first embodiment of the present invention, the activating means includes a timer coupled to the combustion air supplying means to control delivery of combustion air to the mixing region so that such delivery occurs at the time when it is needed most. The timer may be set, for example, to activate the supplying means to supply combustion air to the mixing region during the predetermined time period after initial fire-up of the line burner to supplement the process air and gaseous fuel mixture with "oxygen-rich" combustion air during the time when the oxygen level of the process air drops below the predetermined threshold level. After the oxygen level of the process air rises above the threshold level, the timer shuts off the supplying means to stop the supply of combustion air to the mixing region because it is expected that the process air will contain enough oxygen to support a flame when burned with gaseous fuel.

In a second embodiment of the present invention, the activating means includes an oxygen level sensor coupled to the combustion air supplying means to control activation of the supplying means. The oxygen level sensor is located within the duct means to detect the oxygen level in the process air introduced into the mixing region. If the oxygen level in the process air falls below the threshold level, the oxygen sensor activates the supplying means to supply oxygen-rich combustion air to the mixing region. As long as the oxygen level of the process air is above the threshold level, the supplying means is not activated by the oxygen sensor.

In a third embodiment of the present invention, the activating means includes an inert gas sensor. The inert gas sensor is located within the duct means for sensing the level of inert gas in the process air within the duct means. The inert gas sensor is coupled to the combustion air supplying means to control activation of the supplying means. When the level of inert gas in the process air rises above a predetermined level, the inert gas sensing means activates the supplying means to supply oxygen-rich combustion air to the mixing region. As long as the inert gas level is below a predetermined level, the supplying means is not activated by the inert gas sensor so that no combustion air is supplied to the mixing region.

According to another aspect of the present invention, a method is provided for controlling the proportion of process air and combustion air admitted into a line burner assembly. The method includes the steps of providing a mixing region in a line burner assembly and supplying a gaseous fuel to the mixing region. The method also includes the step of introducing process air containing oxygen and inerts into the mixing region to mix with the gaseous fuel in the mixing region to produce a mixture. The method further includes the step of compensating for a decline in the oxygen level in the process air below a predetermined minimum level by introducing oxygen-rich combustion air into the mixing region to supplement the process air therein and increase the oxygen level of the mixture above a threshold level.

Advantageously, an oxygen supplement acts to enhance the combustability of the fuel-air mixture in the mixing region of the line burner, thereby supporting the flame produced therein. Also advantageously, the present invention provides a line burner assembly which can function solely on a mixture of gas and process air when the oxygen level of the process air is above a predetermined level to reduce operation costs for the line burner and to provide for cleaner operation of the line burner.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
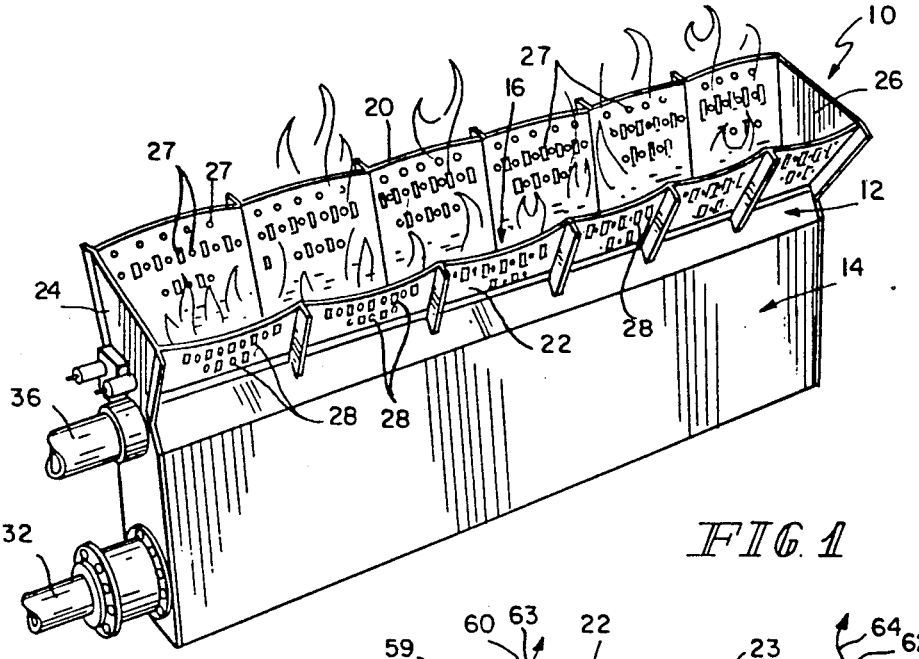
FIG. 1 is a perspective view of a line burner assembly of the present invention.
Figure 3:
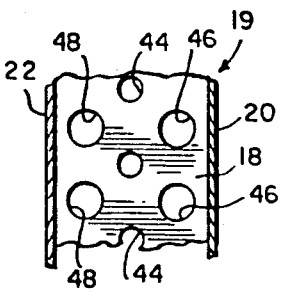
FIG. 3 is a section view taken along lines 3—3 of FIG. 2 illustrating the configuration of the burner base.
Figure 2:
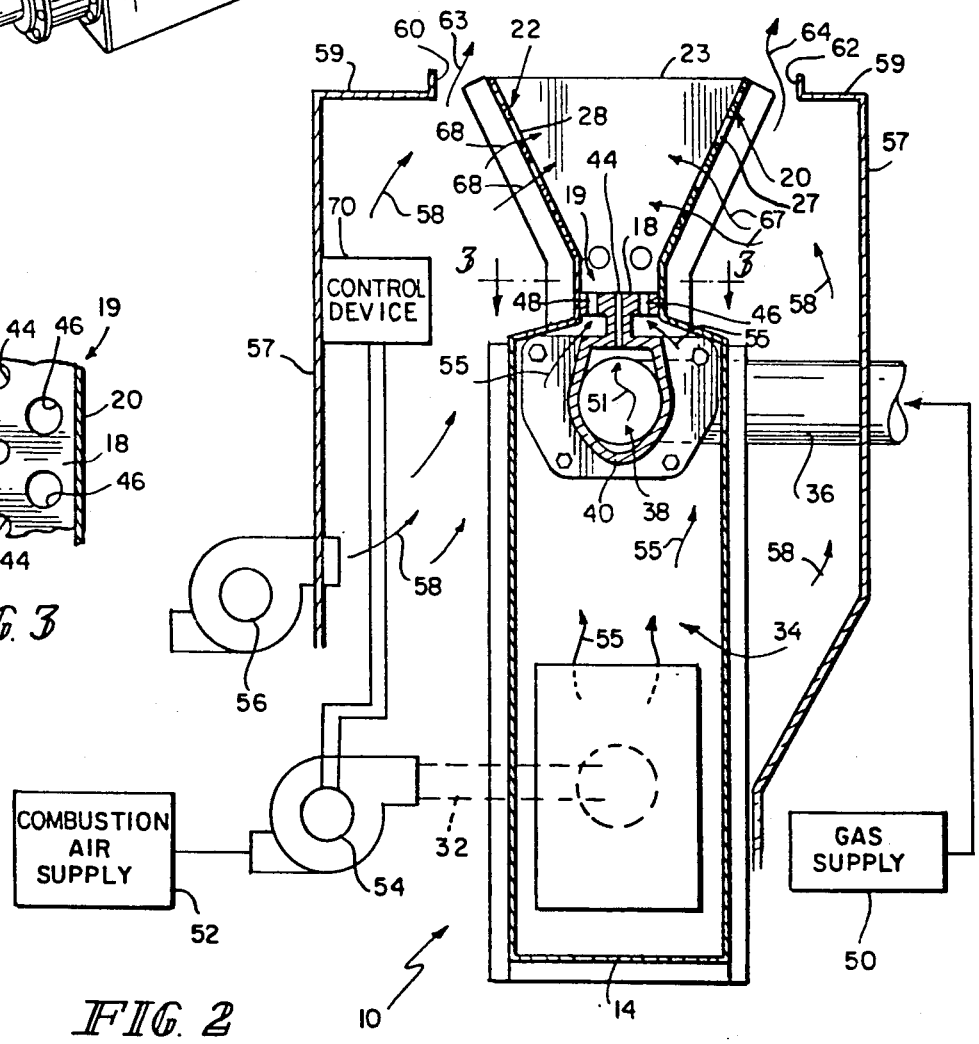
FIG. 2 is a sectional view taken through the line burner assembly of FIG. 1 showing the line burner assembly situated in a process air duct and various air supply and control devices associated with the line burner assembly.

Referring now to the drawings, FIGS. 1-3 illustrate a line burner assembly 10 in accordance with the present invention. The line burner assembly 10 includes a burner body 12 and a combustion air manifold 14. Burner assembly 10 defines a mixing region 16 located to contain a fuel-air mixture therein and support a flame upon combustion of the fuel-air mixture contained therein. Mixing region 16 is bounded in part by burner base 18 and mixing plates 20 and 22. Mixing plates 20 and 22 are located on opposite sides of burner base 18 and are formed to include a plurality of apertures 27 and 28, respectively, therein. End plates 24 and 26 are situated at opposite ends of line burner assembly 10.

A combustion air supply line 32 is coupled to end plate 24 in communication with the internal region 34 of combustion air manifold 14. A gas supply line 36 is also coupled to end plate 24. Gas supply line 36 is placed in communication with internal region 38 of gas manifold 40 and arranged to supply gaseous fuel to gas to gas manifold 40 as best shown in FIG. 2.

Burner base 18 includes a top wall 19 that is formed to include a first array of apertures 44 which are in communication with the internal region 38 of gas manifold 40. The top wall 19 of burner base 18 is also formed to include second and third arrays of apertures 46 and 48, respectively, which communicate with the internal region 34 of combustion air manifold 14 on opposite sides of gas manifold 40. The configuration of the top wall 19 of burner base 18 is best illustrated in FIG. 3. Gas supply means 50 is provided for supplying a gaseous fuel to gas manifold 40 through gas supply line 36. Gas passes in the direction of arrow 51 through apertures 44 in burner base 18 and into mixing region 16.

Combustion air is supplied to combustion air manifold 14 from a combustion air supply 52 by a blower 54 through combustion air supply line 32. Combustion air travels upwardly in the direction of arrows 55 through internal region 34 of combustion air manifold 14 and then through apertures 46 and 48 of burner base 18 and into mixing region 16. The combustion air mixes with the gaseous fuel supplied by gas supply 50 in mixing region 16 to form a combustible air and gas mixture therein only when blower 54 is activated as discussed below. Essentially, combustion air is only admitted into the mixing region 16 to combine with the mixture of gaseous fuel and process air contained therein if the process air is determined or expected to contain low levels of oxygen or high levels of inerts such that it is unable to support a flame properly in the mixing region.

Process air is circulated by a suitable blower 56 through a duct 57 surrounding burner assembly 10 as shown, for example, in FIG. 2. Process air moves around burner assembly 10 as shown by arrows 58. A profile plate 59 is situated near the top edge 23 of burner assembly 10. Profile plate 59 defines elongated first and second apertures 60 and 62 on opposite sides of burner assembly 10 to permit process air to pass through the apertures 60 and 62 in the direction of arrows 63 and 64, respectively. Profile plate 59 creates a pressure drop and forces process air into mixing region 16 through apertures 27 and 28 of mixing plates 20 and 22, respectively. Arrows 67 illustrate process air passing through apertures 27 of mixing plate 20. Arrows 68 illustrate process air passing through apertures 28 of mixing plate 22.

Process air typically contains a mixture of oxygen and inert gases. The process air passing into mixing region 16 mixes with the gas supplied to the mixing region 16 through apertures 44 usually to provide a combustible process air and gas mixture. When the oxygen level in the process air is sufficient to support combustion of the process air and gas mixture, the combustion air supply 52 is shut off or throttled so that the burner assembly 10 operates with only a mixture of the process air and gas provided in mixing region 16.

However, if the inert gas level rises above a predetermined threshold level or the oxygen level in the process air drops below a predetermined threshold level sufficient to support proper combustion of the process air and gas mixture, the flame inside mixing region 16 can become unstable. Therefore, when the oxygen level in the process air drops below the predetermined minimum threshold level, the control means of the present invention activates the combustion air supply 52 to supply combustion air to the mixing region 16 through apertures 46 and 48 in burner base 18 to increase the oxygen level and enhance the combustability of the air and gas mixture in the mixing region 16, thereby supporting and stabilizing the flame produced in the mixing region 16.

There are various methods which may be used for controlling the combustion air blower 54 of the present invention. The control device 70 for controlling blower 54 to supply combustion air is illustrated in FIG. 2. The activating means 70 can be an oxygen sensor designed to activate blower 54 when the oxygen level of the process air within duct 57 drops below the predetermined level. Alternatively, the control device 70 can be an inert gas sensor for sensing when the level of the inert gas in the process air within duct 57 about to be delivered into mixing region 16 is too high. The oxygen sensor or inert gas sensor can be programmed or configured to turn blower 54 off and on. In addition, the sensor could be used to vary the output of blower 54. In this situation, sensor 70 would cause blower 54 to supply larger quantities of combustion air to mixing region 16 as the oxygen level of the process air drops or as the inert gas level of the process air rises and vice versa.

In certain applications, such as a graphics application discussed above in which the burner assembly 10 is used to dry ink or solvents, it is predictable when the oxygen level of the process air is likely to fall below the acceptable minimum threshold level. After a predictable period of time, the oxygen level in the process air rises to a level suitable to sustain the flame. Typically, after the solvent is incinerated and the presses are heated, a less intense flame is required. Therefore, after a predetermined time period, the line burner 10 is able to operate using only a mixture of process air and fuel gas. Therefore, after the predetermined time period, blower 54 can be shut off so that no combustion air is supplied to combustion air manifold 14. In this application, a timer 70 may be used as the activating means to activate blower 54 and supply combustion air from combustion air supply 52 to the combustion air manifold 14 during a preset time period after initially firing the flame. Illustratively, the preset time period is 20 to 40 seconds after firing the burner 10. In other applications, the timer 70 can cycle the blower 54 on and off at selected times instead of only following initial fire up.

In operation, the burner assembly 10 of the present invention is fired to light a flame in mixing region 16 to perform a desired task for a particular application. Gas is supplied to mixing region 16 by gas supply 50 through supply pipe 36, gas manifold 40, and apertures 44. The line burner 10 of the present invention is flexible in that it may sustain combustion by three different modes depending on the application and situation. First, the line burner 10 of the present invention can be be operated with 100% combustion air being mixed with the gas in mixing region 16 for situations in which the process air has low oxygen levels, high inert levels, or high moisture levels. In these situations, the process air stream does not contain enough oxygen to produce a flammable mixture when combined with fuel gas. Therefore, 100% combustion air must be used inside mixing region to support the flame.

In a second mode of operation, the burner assembly 10 can be operated with 100% process air. In this situation blower 54 is shut off or not activated so that no combustion air from combustion air supply 52 is supplied to combustion air manifold 14. This second mode of operation is for situations in which the process air contains sufficient oxygen levels to support combustion of the flame in mixing region 16.

A third mode of operation for line burner assembly 10 is with a combination of combustion air and process air. This third mode is for situations in which the process air quality is variable. The proportions of combustion air and process air can be varied while the burner is in operation to permit the burner assembly 10 to be adaptable to changes in the process air. By varying the amount of combustion air air supplied to mixing region 16, the burner assembly 10 maintains a substantially constant oxygen level inside mixing region 16 to provide a stable flame.

As discussed above, when the oxygen level in the process air falls below a predetermined threshold level necessary to support the flame, combustion air is provided to mixing region 16 by blower 54 through combustion air manifold 14. When the oxygen level in the process air is above the predetermined threshold level necessary to support the flame, then the combustion air supply can be throttled, controlled, or completely shut off using control means 70 to cause the flame to be supported only or partly by the oxygen in the process air.

It is understood that blower 54 can be controlled automatically or manually. An operator could manually turn on a switch to activate blower 54 when the oxygen level of the process air drops below the predetermined threshold level. In addition, the control means 70 can be automatically activate blower 54 when the oxygen level of the process air drops below the predetermined threshold level.

The present invention advantageously provides a high capacity burner with a high turndown ratio. The present burner assembly 10 is also economical because it operates on process air, when possible, which is less expensive to use than combustion air.

One application of a line burner according to the present invention is in an incinerator configured to receive the exhaust product of a plurality of separate printing presses, dryers, paint ovens, or similar devices. Each printing press, for example, will produce process air which can be conducted to a common chamber where it is mixed with the process air produced by the other presses. The process air mixture in this common chamber can then be conducted to the incinerator to provide a supply of process air to a line burner in accordance with the present invention located in the incinerator.

Although the invention has been described in detail with reference to a certain illustrated embodiment, variation and modifications exist within the scope and spirit of the invention as described and defined in the following claims.

What is claimed is:

1. An assembly for burning a mixture including at least a gaseous fuel and process air to produce a flame, the assembly comprising a line burner including a burner base formed to include gas conduit means and air conduit means and means for providing a mixing region, means for supplying a gaseous fuel to the mixing region through said gas conduit means provided in the burner base, means for introducing process air containing oxygen and inerts into the mixing region to mix with the gaseous fuel in the mixing region to produce a mixture, and means for compensating for a decline in the oxygen level in the process air below a predetermined minimum level by introducing combustion air into the mixing region through said combustion air conduit means provided in the burner base to supplement the process air in the mixing region and increasing the oxygen level of the mixture above a threshold level to enhance the combustibility of the mixture in the mixing region, thereby supporting the flame produced therein.

2. The assembly of claim 1, wherein the compensating means includes means for supplying combustion air to the mixing region and means for periodically activating the supplying means to cause combustion air to be supplied to the mixing region to support the flame produced therein when the oxygen level in the process air falls below a predetermined minimum level.

3. The assembly of claim 2, wherein the activating means includes a timer coupled to the supplying means to control activation of the supplying means.

4. The assembly of claim 2, wherein the activating means includes an oxygen level sensor coupled to the supplying means to control activation of the supplying means.

5. The assembly of claim 4, wherein the oxygen level sensor is located to detect the oxygen level in process air introduced into the mixing region.

6. The assembly of claim 2, wherein the activating means includes an inert gas level sensor coupled to the supplying means to control activation of the supplying means.

7. The assembly of claim 6, wherein the inert gas level sensor is located in the introducing means to detect the inert gas level in process air introduced into the mixing region.

8. The assembly of claim 1, further comprising duct means for directing process air toward the mixing region, means for circulating process air through the duct means, combustion air supply means for supplying combustion air to the mixing region, and control means for selectively activating the combustion air supply means in response to a predetermined condition of the process air.

9. The assembly of claim 8, wherein the control means includes oxygen sensing means for sensing the level of oxygen of the process air within the duct means and the oxygen sensing means is coupled to the combustion air supply means to control activation of the combustion air supply means in response to the oxygen level of the process air in the duct dropping below a predetermined level.

10. The assembly of claim 8, wherein the control means includes inert gas sensing means for sensing the level of inert gas of the process air within the duct means, and the inert gas sensing means is coupled to the combustion air supply means to control activation of the combustion air supply means in response to the inert level of the process air in the duct rising above a predetermined level.

11. An assembly for burning a mixture including at least a gaseous fuel and process air to produce a flame, the assembly comprising a line burner including a burner base formed to include gas conduit means and air conduit means and means for providing a mixing region, means for supplying a gaseous fuel to the mixing region through said gas conduit means provided in the burner base, means for introducing process air into the mixing region to mix with the gaseous fuel in the mixing region to produce a mixture, means for adding combustion air into the mixing region through said combustion air conduit means provided in the burner base to increase the level of oxygen extant in the mixture, and means for activating the adding means in response to a decline in the oxygen level of the process air introduced into the mixing region by the introducing means below a predetermined level so that the level of oxygen in the mixture is increased to enhance the combustibility of the mixture in the mixing region to support the flame produced therein.

12. he assembly of claim 11, wherein the activating means includes a timer coupled to the supplying means to control activation of the supplying means.

13. The assembly of claim 11, wherein the activating means includes an oxygen level sensor coupled to the adding means to control activation of the adding means.

14. The assembly of claim 13, wherein the oxygen level sensor is located in the introducing means to detect the oxygen level and process air introduced into the mixing region.

15. The assembly of claim 11, wherein the activating means includes an inert gas level sensor coupled to the adding means to control activation of the adding means.

16. The assembly of claim 15, wherein the inert level sensor is located in the introducing means to detect the inert level and process air introduced into the mixing region.

17. The assembly of claim 11, further comprising duct means for directing process air toward the mixing region, means for circulating process air through the duct means, the activating means supplying combustion air to the mixing region in response to a predetermined condition of the process air.

18. A line burner assembly for burning a mixture including at least a gaseous fuel and process air to produce a flame, the assembly comprising a gas manifold, a combustion air manifold, a burner base including at least one first aperture in communication with the gas manifold and at least one second aperture in communication with the combustion air manifold, and a pair of mixing plates situated on opposite sides of the burner base to define a mixing region therebetween, the mixing plates being formed to include a plurality of apertures therein.

19. The assembly of claim 18, further comprising means for supplying process air to an area surrounding the mixing plates so that process air passes through the apertures in the mixing plates and into the mixing region, means for supplying combustion air to the combustion air manifold, and means for periodically activating the supplying means to cause combustion air to be supplied to the mixing region through the combustion air manifold so that the flame is supported at least in part by oxygen present in the combustion air.

20. The assembly of claim 19, wherein the activating means includes a timer coupled to the supplying means to control activation of the supplying means.

21. The assembly of claim 19, wherein the activating means includes an oxygen level sensor coupled to the supplying means to control activation of supplying means.

22. The assembly of claim 21, wherein the oxygen level sensor is located in the process air supplying means to detect the oxygen level in process air introduced into the mixing region.

23. The assembly of claim 19, wherein the activating means includes an inert gas level sensor coupled to the supplying means to control activation of the supplying means.

24. The assembly of claim 23, wherein the inert level sensor is located in the process air supplying means to detect the inert level in process air introduced into the mixing region.

25. The assembly of claim 18, further comprising duct means for directing process air toward the mixing plates, means for circulating process air through the duct means, combustion air supply means for supplying combustion air to the combustion air manifold, and control means for selectively activating the combustion air supply means in response to a predetermined condition of the process air.

26. The assembly of claim 25, wherein the control means includes oxygen sensing means for sensing the level of oxygen of the process air within the duct means and the oxygen sensing means is coupled to the combustion air supply means to control activation of the combustion air supply means in response to the oxygen level of the process air in the duct dropping below a predetermined level.

27. The assembly of claim 25, wherein the control means includes inert gas sensing means for sensing the level of inert gas of the process air within the duct means and, the inert gas sensing means is coupled to the combustion air supply means to control activation of the combustion air supply means in response to the inert gas level of the process air in the duct rising above a predetermined level.

28. A line burner assembly for burning a mixture including at least a gaseous fuel and process air to produce a flame, the assembly comprising a gas manifold, a combustion air manifold, a burner base including at least one first aperture in communication with the gas manifold and at least one second aperture in communication with the combustion air manifold.

a pair of mixing plates situated on opposite sides of the burner base to define a burner trough therebetween, the mixing plates being formed to include a plurality of apertures therein, means for supplying gas to the gas manifold so that gas passes through the at least one first aperture in the burner base and into the burner trough, means for supplying process air to an area surrounding the mixing plates so that process air passes through the apertures formed in the mixing plates and into the burner trough to mix with the gas, means for supplying combustion air to the combustion air manifold so that primary air passes through the at least one second aperture in the burner base and into the burner trough to mix with the gas, and control means for varying the amount of combustion air supplied to the combustion air manifold by the combustion air supply means in response to a predetermined condition of the process air.

29. The assembly of claim 28, wherein the means for supplying process air to an area surrounding the mixing plates includes a duct formed around the mixing plates and means for circulating process air through the duct.

30. The assembly of claim 28, wherein the control means includes a timer for activating the primary air supply means only for a predetermined time duration.

31. The assembly of claim 28, wherein the control means includes a oxygen sensor situated within the duct for activating the primary air supply means in response to the oxygen level of the process air within the duct falling below a predetermined level.

32. The assembly of claim 28, wherein the control means includes an inert gas sensor situated within the duct for activating the primary air supply means in response to the inert gas level of the process air within the duct rising above a predetermined level.

33. An assembly for burning a mixture including at least a gaseous fuel and process air to produce a flame, the assembly comprising a line burner including a burner base formed to include gas conduit means and air conduit means and means for providing a mixing region, means for supplying a gaseous fuel to the mixing region through said gas conduit means provided in the burner base, means for introducing process air containing oxygen and inerts into the mixing region to mix with the gaseous fuel in the mixing region to produce a mixture, means for supplying combustion air to the mixing region through said air conduit means provided in the burner base, and means for varying the level of combustion air supplied to the mixing region by the supplying means during operation of the assembly to compensate for a decline in the oxygen level in the process air below a predetermined minimum level to enhance the combustibility of the mixture in the mixing region, thereby supporting the flame produced therein.

34. The assembly of claim 33, wherein the varying means includes a timer coupled to the supplying means to control activation of the supplying means.

35. The assembly of claim 33, wherein the varying means includes an oxygen level sensor coupled to the supplying means to control activation of the supplying means.

36. The assembly of claim 35, wherein the oxygen level sensor is located in the introducing means to detect the oxygen level in process air introduced into the mixing region.

37. The assembly of claim 33, wherein the varying means includes an inert gas level sensor coupled to the supplying means to control activation of the supplying means.

38. The assembly of claim 37, wherein the inert gas level sensor is located in the introducing means to detect the inert gas level in the process air introduced into the mixing region.

39. A method for controlling the mixture of process air and combustion air with a gaseous fuel in a line burner having a gas manifold, a combustion air manifold, a burner base including at least one first aperture in communication with the gas manifold and at least one second aperture in communication with the primary air manifold, and a pair of mixing plates situated on opposite sides of the burner base to define a burner trough therebetween, the mixing plates being formed to include a plurality of apertures therein, the method comprising the steps of supplying gas to the gas manifold so that gas enters the burner trough through the at least one first aperture of the burner base, supplying process air containing oxygen and inerts to an area around the mixing plates so that the process air passes through the apertures formed in the mixing plates and into the burner trough, the process air mixing with the gas to provide a combustible mixture within the burner trough, and selectively supplying combustion primary air manifold so that combustion air enters the burner trough through the at least one second aperture in the burner base in response to the oxygen level of the process air falling below a predetermined level.

* * * * *